US005192461A

United States Patent [19]

Tomaszewski et al.

[11] Patent Number: 5,192,461

[45] Date of Patent: Mar. 9, 1993

[54] AQUEOUS DEGREASING SOLUTION HAVING HIGH FREE ALKALINITY

[75] Inventors: Lillie C. Tomaszewski, Dearborn; James R. Crain, Northville, both of Mich.

[73] Assignee: Enthone-OMI, Inc., West Haven, Conn.

[21] Appl. No.: 749,126

[22] Filed: Aug. 23, 1991

[51] Int. Cl.[5] ..... C11D 3/22; C11D 7/08; C23G 1/06

[52] U.S. Cl. ..... 252/156; 252/DIG. 14; 252/DIG. 17; 252/158; 252/174.21; 252/525

[58] Field of Search ..... 252/DIG. 14, DIG. 17, 252/174.21, 156, 158, 525

[56] References Cited

U.S. PATENT DOCUMENTS

| | | | |
|---|---|---|---|
| H269 | 5/1987 | Malik | 252/174.17 |
| 3,010,907 | 11/1961 | Carroll | 252/DIG. 14 |
| 3,031,408 | 4/1962 | Perlman et al. | 252/174.17 |
| 3,738,943 | 6/1973 | Kaneko | 252/174.17 |
| 3,741,913 | 6/1973 | Waag | 252/174.17 |
| 4,018,696 | 4/1977 | Hellsten et al. | 252/DIG. 14 |
| 4,137,190 | 1/1979 | Chakrabarti et al. | 252/DIG. 17 |
| 4,147,652 | 4/1979 | Kaniecki | 252/DIG. 14 |
| 4,240,921 | 12/1980 | Kaniecki | 252/DIG. 14 |
| 4,349,448 | 9/1982 | Steele | 252/174.21 |
| 4,374,036 | 2/1983 | Canale et al. | 252/173 |
| 4,396,520 | 8/1983 | Payne et al. | 252/174.17 |
| 4,477,365 | 10/1984 | Verboom et al. | 252/158 |
| 4,556,509 | 12/1985 | Demangeon et al. | 252/544 |
| 4,561,991 | 12/1985 | Herbots et al. | 252/171 |
| 4,578,208 | 3/1986 | Geke et al. | 252/174.21 |
| 4,606,850 | 8/1986 | Malik | 252/174.17 |
| 4,618,447 | 10/1986 | Seelig | 252/174.16 |
| 4,668,422 | 5/1987 | Malik et al. | 252/174.17 |
| 4,683,074 | 7/1987 | Malik et al. | 252/174.17 |
| 4,705,665 | 11/1987 | Malik | 252/174.17 |
| 4,769,172 | 9/1988 | Siklosi | 252/171 |
| 4,810,421 | 3/1989 | Marchesini | 252/156 |
| 4,834,903 | 5/1989 | Roth et al. | 252/174.17 |
| 4,844,744 | 7/1989 | Leiter et al. | 252/174.24 |
| 4,906,396 | 3/1990 | Falholt et al. | 252/174.12 |
| 4,965,014 | 10/1990 | Jeschke et al. | 252/174.22 |
| 5,080,831 | 1/1992 | VanEenam | 252/171 |

*Primary Examiner*—Ronald W. Griffin
*Attorney, Agent, or Firm*—Richard P. Mueller

[57] ABSTRACT

A low solids, solvent free liquid aqueous degreasing concentrate composition having high free alkalinity which includes from about 20% to about 40% by weight of an alkali builder constituent; from about 15% to about 25% by weight of a wetting agent mixture comprising; from about 60% to about 85% of an anionic or amphoteric wetting agent selected from the group consisting of anionic surfactants and amphoteric and anionic hydrotropes and from about 15% to about 40% non-ionic wetting agents; and the remainder water.

42 Claims, No Drawings

AQUEOUS DEGREASING SOLUTION HAVING HIGH FREE ALKALINITY

BACKGROUND

The present invention relates to a substantially solvent free aqueous based degreasing concentrate solution for removing heavy soils from manufactured parts or the like.

In the past, many hydrocarbon solvents have been used to degrease and prepare parts for plating or coating operations or the like. Particularly, fluorinated or chlorinated hydrocarbons such as Freon ® and the like have received extremely favorable use in degreasing operations in industry. Such solvents are effective in removing even the toughest industrial soils. However, during drying phases invariably some of the solvents are lost to the atmosphere. Because of these losses, extremely large quantities of these solvents are expelled into the atmosphere by industry each year.

Of course, in recent years fluorocarbons have come under increasing attack due to ozone layer depletion, believed to be caused by fluorocarbons. Thus, while many industries continue to use the fluorocarbon type solvents as degreasers, manufacturers of solvent cleaning equipment have concentrated on attempting to reduce effluents to the atmosphere by special condensation machinery and the like. Even with improved degreasing machinery available today thousand of tons of fluorocarbons are released to the atmosphere every year because of solvent type degreasing operations.

Thus, there has been an increasing need in the art to provide a solvent free degreasing system which would replace in whole or in part these prior art solvent systems. Aqueous systems have been favored because of low environmental impact. However, the prior art has seemingly failed to provide a suitable aqueous system, that would work in industrial degreasing operations, to effectively remove tough soils such as rust inhibitors, greases, oils, buffing compounds, waxes, cutting oils, forming oils and quench oils, for instance. Other aqueous cleaners are undesirable in certain applications in that some constituents used in such cleaners may not be compatible with the substrates to be cleaned. Thus, it has been a goal in the art and is an object of the present invention to produce an aqueous degreasing composition which is strong enough and effective enough to replace a solvent type degreasing system.

Also, it has been a goal in the art to produce a cleaner which will not detrimentally effect substrate parts to be degreased.

SUMMARY OF THE INVENTION

In the present invention these goals and objectives are met by providing an aqueous based cleaner which is substantially solvent free and will suitably clean heavy soils such that it can replace solvent type degreasing operations. In accordance with the present invention there is provided a substantially solvent free aqueous degreasing concentrate composition comprising from about 20% to about 40% by weight of an alkali builder constituent; from about 15% to about 25% by weight of a wetting agent mixture which comprises from about 60% to about 85% of an anionic or amphoteric wetting agent selected from the group consisting essentially of anionic surfactants and amphoteric and anionic hydrotropes with about 15% to about 40% of the wetting agent mixture comprising a non-ionic wetting agent.

The remainder of the composition is water. Compositions of the present invention are aqueous degreasing compositions. In accordance with the method aspects of the present invention the above concentrate may be diluted and used in concentrations of from 1% to 100% for degreasing of parts. The degreasing method includes spray application, soak cleaning with or without agitation.

Additional benefits and advantages of the present invention will become apparent from the subsequent description of the preferred embodiment and the appended claims taken in conjunction with the examples wherein percentages given are percentages by weight unless set forth otherwise.

DESCRIPTION OF THE PREFERRED EMBODIMENTS

In its broad aspects the present invention is a low solid solvent free aqueous degreasing concentrate composition. The concentrate composition of the present invention includes from about 20% to about 40% by weight of an alkali builder constituent. Also included in the composition of the present invention is from about 15% about 25% of a wetting agent mixture. The wetting agent mixture includes from about 60% to about 85% of an anionic or amphoteric wetting agent which is selected from the group consisting of anionic surfactants and amphoteric and anionic hydrotropes. From about 15% to about 40% of the wetting agent mixture is comprised of nonionic wetting agents. The remainder of the composition is water. Thus, compositions of the present invention are aqueous in nature and are substantially solvent free.

The alkali builder constituent may be utilized in one or more of readily known alkali compounds such as potassium hydroxide, sodium hydroxides, potassium carbonates, phosphates or other alkaline solution forming constituents. In a preferred embodiment of the present invention the alkali builder is preferably a sodium hydroxide or potassium hydroxide material.

The non-ionic wetting agent constituent is selected from the group which includes ethylene oxide adducts of ethylenes and polyonyls, alkyl glucosides, oligosaccharides, block copolymers of polyoxy propylene polyoxetrine and mixtures thereof.

With respect to the anionic or amphoteric wetting agents utilized in the preferred embodiment of the present invention, from about 80% to about 90% of a hydrotrope constituent is utilized with the remainder being an anionic surfactant. Suitable hydrotropes include a mixture of a polyphosphoric acid ester having a polyethylene glycol decyl ether moiety mixed with a phosphate ester potassium salt. The anionic constituent utilized in the anionic or amphoteric wetting agent is preferably an alkyl imidazolinium dicarboxylate sodium salt. In a particularly preferred embodiment of the present invention from about 1% to about 1.5% of a triethanol amine linear alkyl aryl sulfonate is utilized.

The hydrotrope constituent in a most preferred embodiment, comprises from about 60% to about 85% and preferably from about 70% to about 74% of a polyphosphate ester potassium salt; from about 15% to about 40% and preferably 26% to about 30% of the polyphosphoric ester with polyethylene glycol decyl ether. These hydrotropes advantageously provide for increased solubility of the ethoxylated nonyl phenol composition in the solutions of the present invention.

A particularly preferred embodiment of the present invention includes the following constituents: from about 0.5% to about 1% of a constituent comprising mixed alkyl glucosodes and oligosaccharides; about 2.5% of an ethoxylated nonylphenol; about 3.5% of a constituent comprising poly phosphoric esters with polyethylene glycol decyl ether; about 9% of a phosphate ester potassium salt; about 2.0% of an alkyl imadazolinium dicarboxylated sodium salt; from about 1.0% to about 1.5% of a triethanolamine linear alkylated sulfonate; from about 8.0% to about 14.0% tetrapotassium pyrophosphate; and about 50% potassium hydroxide with the remainder water. In an alternate preferred embodiment 8% of a gluconic acid constituent is preferably utilized.

Compositions of the present invention may be used as concentrates or diluted in solutions of from about 1%-100% depending on the degreasing operation and soils to be removed from the substrate. Particularly preferred operating environments for degreasing compositions of the present invention include some type of agitation such as mechanical or ultrasonic agitation which improves the results of degreasing when utilizing compositions of the present invention. However, the compositions may also be sprayed onto parts for degreasing thereof. After degreasing, the parts may be rinsed with suitable water rinses or the like.

Preferred compositions range from about 1% to about 10% dilutions of the concentrate in water. These solutions are preferably operated at temperatures of from about 120° F. to about 160° F. Solutions of the present invention have high free alkalinity resulting in operating pH's of above 12. Therefore, these solutions typically are suitable for metals and alloys which are not sensitive to high alkalinity. If soak cleaning is used as a degreasing procedure solutions of 5% to 10% concentrate are used. If utilizing mechanical agitation equipment particularly preferred concentrations of about 2% to about 5% may be utilized. With ultrasonic cleaning equipment particularly preferred concentrations of from about 1% to about 7% may be utilized.

Compositions of the present invention are particularly advantageous in that they have low solids content of about 35% or less. Degreasing compositions of the present invention are particularly suitable for steel, stainless steel, titanium and alloys containing high quantities of nickel, chromium, and/or cobalt, such as Rene 80, Rene 142 and X-40 alloy.

Further understanding of the present invention will be had with reference to the examples set forth below which are set forth herein for purposes of illustration but not limitation.

EXAMPLE I

A concentrate formulation was prepared using the constituents set forth in Table I.

TABLE I

| Constituent | Percentage |
|---|---|
| gluconic acid | 8% |
| mixed alkyl glucoside oligo sacharrides[1] | 1% |
| block co-polymer, polyoxy propylene polyoxetrine[2] | 0.5% |
| ethoxylated nonylphenol[3] | 2.5% |
| poly phosphoric acid ester with poly ethylene glycol decyl ether[4] | 3.5% |
| phosphate ester potassium salt[5] | 9.0% |
| alkyl imadazolinium dicarboxylate sodium salt[6] | 2.0% |
| triethanolamine linear alkylated sulfonate[7] | 1.0% |
| tetrapotassium pyrophosphate | 8.0% |
| potassium hydroxide (45% solution) | 50% |
| water | 15.5% |

[1]Triton ® BG-10 Rohm & Haas
[2]Pluronic ® L-61 BASF
[3]Igepal ® CO-730 GAF
[4]Chemfac ® PD 600 Chemax, Inc.
[5]Triton H-55
[6]Miranol ® C-2 M-57
[7]Biosoft ® N-300 Stepan Chemical The solution as set forth in Table I was utilized to degrease quenching oil from parts for 2 to 3 minutes for 150° F. to 160° F. in 5% solution of the concentrate.

EXAMPLE II

A concentrate solution was made in accordance with the constituents set forth in Table II.

TABLE II

| Constituent | Percentage |
|---|---|
| mixed alkyl glucoside and oligosaccharides[1] | 0.5% |
| ethoxylated nonylphenol[2] | 2.5% |
| poly phosphoric esters with polyethylene glycol decyl ether[3] | 3.5% |
| phosphate ester potassium salt[4] | 9% |
| alkyl imadazolinium dicarboxylated sodium salt[5] | 2.0% |
| triethanolamine linear alkylated sulfonate[6] | 1.5% |
| tetrapotassium pyrophosphate | 14.0% |
| potassium hydroxide (45% solution) | 50.0% |
| water | 16.0% |

[1]Triton ® BG-10 Rohm & Haas
[2]Igepal ® CO-730 GAF
[3]Chemfac ® PD 600 Chemax, Inc.
[4]Triton H-55
[5]Miranol ® C-2 M-57
[6]Biosoft ® N-300 Stepan Chemical The above solution was utilized in a 5% concentration mixed with water and was found to degrease quenching oil from parts in about 2 to 3 minutes up to solvent levels of quality when used at a temperature of 150° F. to 160° F. Ultrasonic agitation was used in Tables I and II reducing the clean up time to 15 to 30 seconds and allowing reduction in the temperature to 130° F.

EXAMPLE III

Degreasing compositions are prepared one having in a first composition 20% of an alkali builder and 15% of a wetting agent. The wetting agent includes 85% of an anionic surfactant or amphoteric wetting agent and 15% non-ionic wetting agents with the remainder water. A second composition is prepared having 40% of an alkali builder; 25% of a wetting agent mixture which includes 60% of an anionic or amphoteric wetting agent consisting of anionic surfactants and amphoteric and anionic hydrotropes, and 40% non-ionic wetting agents with the remainder water.

The above compositions are utilized in solutions having from 1% to 100% composition in water. The compositions are found suitable for various degreasing operations.

While the above description constitutes the preferred embodiments of the present invention it is to be appreciated that the invention is susceptible to modification, variation and change without departing from the proper scope and the fair meaning of the accompanying claims.

What is claimed is:

1. A low solids, solvent free liquid aqueous degreasing concentrate composition having high free alkalinity comprising:

from about 20% to about 40% by weight of an alkali builder constituent;

from about 15% to about 25% by weight of a wetting agent mixture which will remain effective in high alkaline solutions comprising; from about 60% to about 85% of an anionic ar amphoteric wetting agent selected from the group consisting of anionic surfactants and amphoteric and anionic hydrotropes and water.

2. The composition according to claim 1 wherein the non-ionic wetting agent is selected from the group consisting of ethylene oxide adducts of phenols and polyonyls; alkyl glucosides, oligosaccharides, block copolymers of polyoxy propylene polyoxetrines and mixtures thereof.

3. The composition of claim 1 wherein said anionic or amphoteric wetting agent further comprises from about 80% to about 90% of a hydrotrope with the remainder being an anionic surfactant.

4. The composition of claim 3 wherein said hydrotrope further comprises a mixture of a polyphosphoric acid ester with a polyethylene glycol decyl ether moiety and a phosphate ester potassium salt.

5. The composition of claim 3 wherein the anionic surfactant further comprises an alkyl imidazolinium dicarboxylate sodium salt.

6. A low solids solvent free liquid aqueous degreasing concentrate composition of high free alkalinity comprising:

from about 20% to about 40% by weight of an alkali builder constituent; from about 15% to about 25% by weight of a wetting agent which will remain effective in high alkaline solutions which comprises 75% of an anionic or amphoteric wetting agent and about 25% of a non-ionic wetting agent wherein the anionic amphoteric wetting agent further comprises from about 80% to about 90% hydrotrope with the remainder being an anionic surfactant; and said non-ionic constituent is selected from the group consisting of: ethylene oxide adducts of phenols and polyonyls; alkyl glucosides, oligosaccharides, a block co-polymer of a polyoxy propylene polyoxetrine, and from about 1.0% to about 1.5% of a triethanolamine linear alkyl aryl sulfonate, and water.

7. The composition of claim 6 wherein the hydrotrope is selected from the group consisting of: a polyphosphoric acid ester with polyethylene glycol decyl ether, a phosphate ester potassium salt and mixtures thereof.

8. The composition of claim 7 wherein said anionic surfactant further comprises an alkyl imidazolinium dicarboxylate sodium salt.

9. The composition of claim 6 wherein the hydrotrope constituent further comprises from about 60% to about 85% of a phosphate ester potassium salt; from about 15% to about 40% of the polyphosphoric acid ester with polyethylene glycol decyl ether.

10. The composition of claim 9 wherein the hydrotrope constituent further comprises from about 70% to about 74% of a phosphate ester potassium salt; from about 26% to about 30% of the polyphosphoric acid ester with polyethylene glycol decyl ether.

11. A substantially solvent free degreasing composition comprising:

from about 0.5% to about 1% of a constituent comprising mixed alkyl glucosodes and oligosaccharides;

about 2.5% of an ethoxylated nonylphenol;

about 3.5% of a constituent comprising poly phosphoric esters with polyethylene glycol decyl ether;

about 9% of a phosphate ester potassium salt;

about 2.0% of an alkyl imadazolinium dicarboxylated sodium salt;

from about 1.0% to about 1.5% of a triethanolamine linear alkylated sulfonate;

from about 8.0% to about 14.0% tetrapotassium pyrophosphate;

about 50% potassium hydroxide; and water.

12. The degreasing composition of claim 11 further comprising about 8% of a gluconic acid constituent.

13. The degreasing composition of claim 11 further comprising a dilution of from about 1% to about 100% of said composition in water.

14. The degreasing composition of claim 12 further comprising a dilution of from about 1% to about 100% of said composition in water.

15. The degreasing composition of claim 13 further comprising a dilution of from about 1% to about 10% of said composition in water.

16. The degreasing composition of claim 14 further comprising a dilution of from about 1% to about 10% of said composition in water.

17. The degreasing composition of claim 15 further comprising a dilution of from about 5% to about 10% of said composition in water.

18. The degreasing composition of claim 16 further comprising a dilution of from about 5% to about 10% of said composition in water.

19. The degreasing composition of claim 15 further comprising a dilution of from about 1% to about 7% of said composition in water.

20. The degreasing composition of claim 16 further comprising a dilution of from about 1% to about 7% of said composition in water.

21. The degreasing composition of claim 19 further comprising a dilution of from about 2% to about 5% of said composition in water.

22. The degreasing composition of claim 20 further comprising a dilution of from about 2% to about 5% of said composition in water.

23. A process of degreasing a soiled substrate comprising the steps of:

a. preparing a liquid aqueous dilution of from about 1% to 100% by volume of a degreasing concentrate of high free alkalinity comprising:

from about 20% to about 40% by weight of an alkali builder constituent;

from about 15% to about 25% by weight of a wetting agent mixture which will remain effective in high alkaline solutions comprising; from about 60to about 85% of an anionic or amphoteric wetting agent selected from the group consisting of anionic surfactants and amphoteric and anionic hydrotropes and from about 15% to about 40% non-ionic wetting agents; and water; and b. causing said aqueous dilution to contact said soiled substrate.

24. The process of claim 23 wherein said step b is accomplished by spraying of the aqueous dilution onto the soiled substrate.

25. The process of degreasing of claim 23 wherein step b is accomplished by immersing the substrate in said aqueous dilution and agitating the solution.

26. The process of degreasing of claim 25 wherein said agitation is accomplished by ultrasonics.

27. The process of claim 25 wherein said agitation is accomplished by physical agitation.

28. The process of claim 25 wherein said agitation is accomplished by aeration.

29. The process according to claim 23 wherein a dilution of from about 1% to about 10% is utilized.

30. The process of claim 23 wherein a dilution of about 2% to about 5% is utilized with mechanical agitation.

31. The process of claim 23 wherein a dilution of from about 1% to about 7% is utilized with ultrasonic agitation of the solution.

32. The process of claim 23 wherein a dilution of from about 5% to about 10% is utilized for soak cleaning of said soiled substrate.

33. A process of degreasing a soiled substrate comprising the steps of:

a. preparing an aqueous dilution of from about 1% to about 100% by volume of a degreasing concentrate comprising:

from about 0.5% to about 1% of a constituent comprising mixed alkyl glucosides and oligosaccharides;

about 2.5% of an ethoxylated nonylphenol;

about 3.5% of a constituent comprising poly phosphoric esters with polyethylene glycol decyl ether;

about 9% of a phosphate ester potassium salt;

about 2.0% of an alkyl imadazolinium dicarboxylated sodium salt;

from about 1.0% to about 1.5% of a triethanolamine linear alkylated sulfonate;

from about 8.0% to about 14.0% tetrapotassium pyrophosphate;

about 50% potassium hydroxide with the remainder water; and b. causing said aqueous dilution to contact said soiled substrate.

34. The process of claim 33 wherein said step b is accomplished by spraying of the aqueous dilution onto the soiled substrate.

35. The process of degreasing of claim 33 wherein step b is accomplished by immersing the substrate in said aqueous dilution and agitating the solution.

36. The process of degreasing of claim 35 wherein said agitation is accomplished by ultrasonics.

37. The process of claim 35 wherein said agitation is accomplished by physical agitation.

38. The process of claim 35 wherein said agitation is accomplished by aeration.

39. The process according to claim 33 wherein a dilution of from about 1% to about 10% is utilized.

40. The process of claim 33 wherein a dilution of about 2% to about 5% is utilized with mechanical agitation.

41. The process of claim 33 wherein a dilution of from about 1% to about 7% is utilized with ultrasonic agitation of the solution.

42. The process of claim 33 wherein a dilution of from about 5% to about 10% is utilized for soak cleaning of said soiled substrate.

* * * * *

UNITED STATES PATENT AND TRADEMARK OFFICE

CERTIFICATE OF CORRECTION

PATENT NO. : 5,192,461

DATED : March 9, 1993

INVENTOR(S) : Tomaszewski, et al.

It is certified that error appears in the above-identified patent and that said Letters Patent is hereby corrected as shown below:

Title Page, Item [57], ABSTRACT, Line 7, "comprising;" should be --comprising:--.

Column 3, Line 62, "oligo sacharrides[1]" should be --oligosacharrides[1]--.

Column 5, Line 14, Claim 1, "comprising;" should be --comprising:--.

Column 5, Line 15, Claim 1, "ar" should be --or--.

Column 5, Lines 17-18, Claim 1, after "hydrotropes", insert --and from about 15% to about 40% non-ionic wetting agents;--.

Column 6, Line 63, Claim 23, "comprising;" should be --comprising:--.

Column 6, Line 64, Claim 23, "60to" should be --60% to--.

Signed and Sealed this

Sixth Day of April, 1999

*Attest:*

*Attesting Officer*

Q. TODD DICKINSON

*Acting Commissioner of Patents and Trademarks*